US008672327B2

(12) United States Patent
Griffith

(10) Patent No.: US 8,672,327 B2
(45) Date of Patent: Mar. 18, 2014

(54) GLOBAL PROPERTY TRADING BOARD GAME

(76) Inventor: Michael Griffith, St. Philip Parish (BB)

( * ) Notice: Subject to any disclaimer, the term of this patent is extended or adjusted under 35 U.S.C. 154(b) by 1116 days.

(21) Appl. No.: 11/560,134

(22) Filed: Nov. 15, 2006

(65) Prior Publication Data

US 2008/0111302 A1 May 15, 2008

(51) Int. Cl.
*A63F 3/00* (2006.01)

(52) U.S. Cl.
USPC ..... 273/278; 273/256

(58) Field of Classification Search
USPC ..... 273/256, 278
See application file for complete search history.

(56) References Cited

U.S. PATENT DOCUMENTS

| | | | | | |
|---|---|---|---|---|---|
| 3,756,604 | A | * | 9/1973 | Laszlo | 273/255 |
| 4,445,692 | A | | 5/1984 | Boyle | |
| 4,890,843 | A | * | 1/1990 | Chauve | 273/246 |
| 4,928,967 | A | * | 5/1990 | Woodliff | 273/254 |
| 5,118,115 | A | * | 6/1992 | Codinha | 273/255 |
| 5,292,133 | A | * | 3/1994 | Alexander | 273/256 |
| 5,388,835 | A | | 2/1995 | Albright | |
| 5,388,836 | A | | 2/1995 | Foti | |
| 5,405,140 | A | * | 4/1995 | Terlinden et al. | 273/251 |
| 5,415,411 | A | | 5/1995 | Peterson | |
| 5,755,442 | A | | 5/1998 | Cudd | |
| 5,788,235 | A | | 8/1998 | Thomas | |
| 6,019,371 | A | | 2/2000 | Mantis | |
| 6,224,056 | B1 | * | 5/2001 | Jones | 273/249 |
| 6,412,777 | B1 | * | 7/2002 | Rossi | 273/243 |

* cited by examiner

*Primary Examiner* — Vishu K. Mendiratta
(74) *Attorney, Agent, or Firm* — Howard Natter; Natter & Natter

(57) ABSTRACT

A global property trading board game having a game board with a continuous travel path divided into stations being associated with respective countries and having markings, including economic values representative of the respective countries' gross domestic product. Movement of a game-piece along the travel path is determined by a chance-controlled device. Each player is allocated a line of credit represented by international business cards in various monetary denominations. The respective players are further assigned a global region constituting a trade-bloc of countries. A player may acquire the assets of any country corresponding to the station in which the game-piece is located, assuming the assets are not owned by another player, by payment of the designated economic value utilizing the player's international business cards. When a competing player's game-piece is located within a station wherein the assets are owned by another player the competing player must pay a tax to that player. Several of the stations are keyed to playing cards that impose either a monetary penalty, or a monetary reward; other stations affect advancement of the respective player's game-piece. The player who acquires all or most of the countries' assets within its assigned trade-bloc and has successfully defended its home sovereignty is the victor.

8 Claims, 4 Drawing Sheets

GLOBAL PROPERTY TRADING BOARD GAME

BACKGROUND OF THE INVENTION

1. Field of the Invention

The present invention relates to competitive amusement devices and especially to a board game involving movement of a game-piece on a board having a pattern wherein chance controls the amount of movement of the game-piece.

In particular, the board game of this invention concerns global property transactions involving the simulated acquisition of global assets and the defense of national sovereignty.

2. Description of Related Art

Many board games involve a race wherein a player throws dice and moves a game-piece around a track in accordance with the numerical markings on the respective die; these games are primarily dependent on chance controlled movement. Another game category concerns strategy board games, an object of which is to capture territory; these games are usually more mind-engaging. Financial board games, such as games that include property transactions, can involve both chance dependency and mental strategy. Typical of these games are business-oriented board games that include a defined travel path divided into stations and a game-piece assigned to each player for advancement along the travel path, as for example, is disclosed in U.S. Pat. Nos. 5,788,235 and 5,755,442. The aforementioned board games, however, do not have a global economics theme. Although the aspect of international finance has been introduced in board games such as shown in U.S. Pat. Nos. 4,445,692; 5,388,836; 5,292,133, and 5,415,411, these games are generally revenue-driven and do not incorporate strategies for protecting national economic sovereignty while acquiring the assets of various countries.

Another deficiency of many of the previously described board games is that a relatively prolonged timeframe for game play is required and the players frequently lose interest before completion of the game.

SUMMARY OF THE INVENTION

Briefly, the nature of this invention concerns to a board game intended to simulate a virtual airplane tour around the world wherein each player assumes the role of an international businessman or diplomat assigned to purchase global assets in various countries in competition with fellow diplomats from other nations, while each diplomat defends the national economic sovereignty of the home territory.

The invention encompasses a game board defining a continuous travel path divided into stations, including stations associated with a country or countries having a designated monetary evaluation representative of the gross domestic product of the respective country. Each player is assigned a global region wherein the countries therein constitute a trade-bloc and is further allocated a "line of credit" embodied in the form of international business cards in varying denominations.

An objective of the game is for the player to move a game-piece along the travel path in accordance with the throw of a set of three dice and to acquire and hold the assets of the countries within the player's assigned trade-bloc while preventing competing players from acquiring said countries' assets. Movement of the player's game-piece is also affected by various "penalties" and "advantages" keyed to stations along the travel path. The game strategy also allows for players to form alliances and compete as teams. The game is won by the player who best defends his/her trade-bloc though ownership of most, if not all, of the countries' assets within his/her trade-bloc to thus preserve that player's national economic sovereignty.

Having thus summarized the invention, it should be seen that is a preferred object of this invention to provide a global property trading board game of the general character described herein which has many of the advantages of the board games mentioned heretofore and many novel features that result in a new and improved global property trading board game.

It is still another preferred object of the present invention to provide a global property trading board game wherein the players can develop global strategies for protecting the players' national economic sovereignty.

It is a further preferred object of the present invention to provide a global property trading board game that offers an entertaining and learning experience.

Yet still another object of the present invention is to provide a global property trading board game that provides accelerated game play for maintaining player interest.

It is another preferred object of the present invention to provide a global property trading board game which may be easily and efficiently manufactured and marketed.

Other preferred objects of this invention will in part be apparent and in part will be pointed out hereinafter.

With these ends in view, the invention finds embodiment in certain combinations of elements and arrangements of parts by which the aforementioned preferred objects and certain other objects are hereinafter attained, all as more fully described with reference to the accompanying drawings, and the scope of which is more particularly pointed and indicated in the appended claims.

BRIEF DESCRIPTION OF THE DRAWINGS

In the accompanying drawings, in which is shown an exemplary embodiment of the invention.

DETAILED DESCRIPTION OF THE INVENTION

Figure 1A:
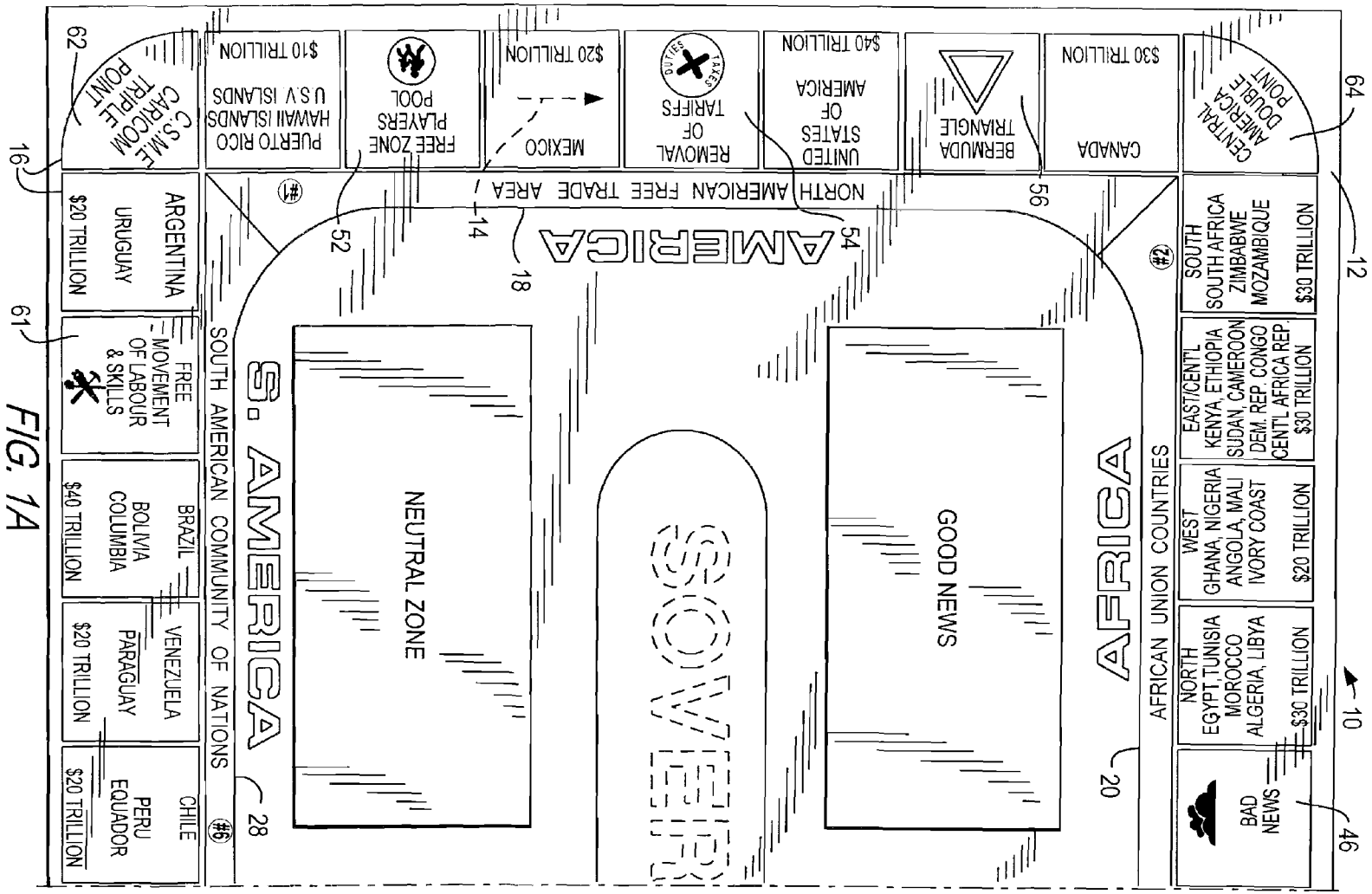
FIG. 1A is a plan view of a left-half portion of a game board in accordance with to the present invention showing a travel path.
Figure 1B:
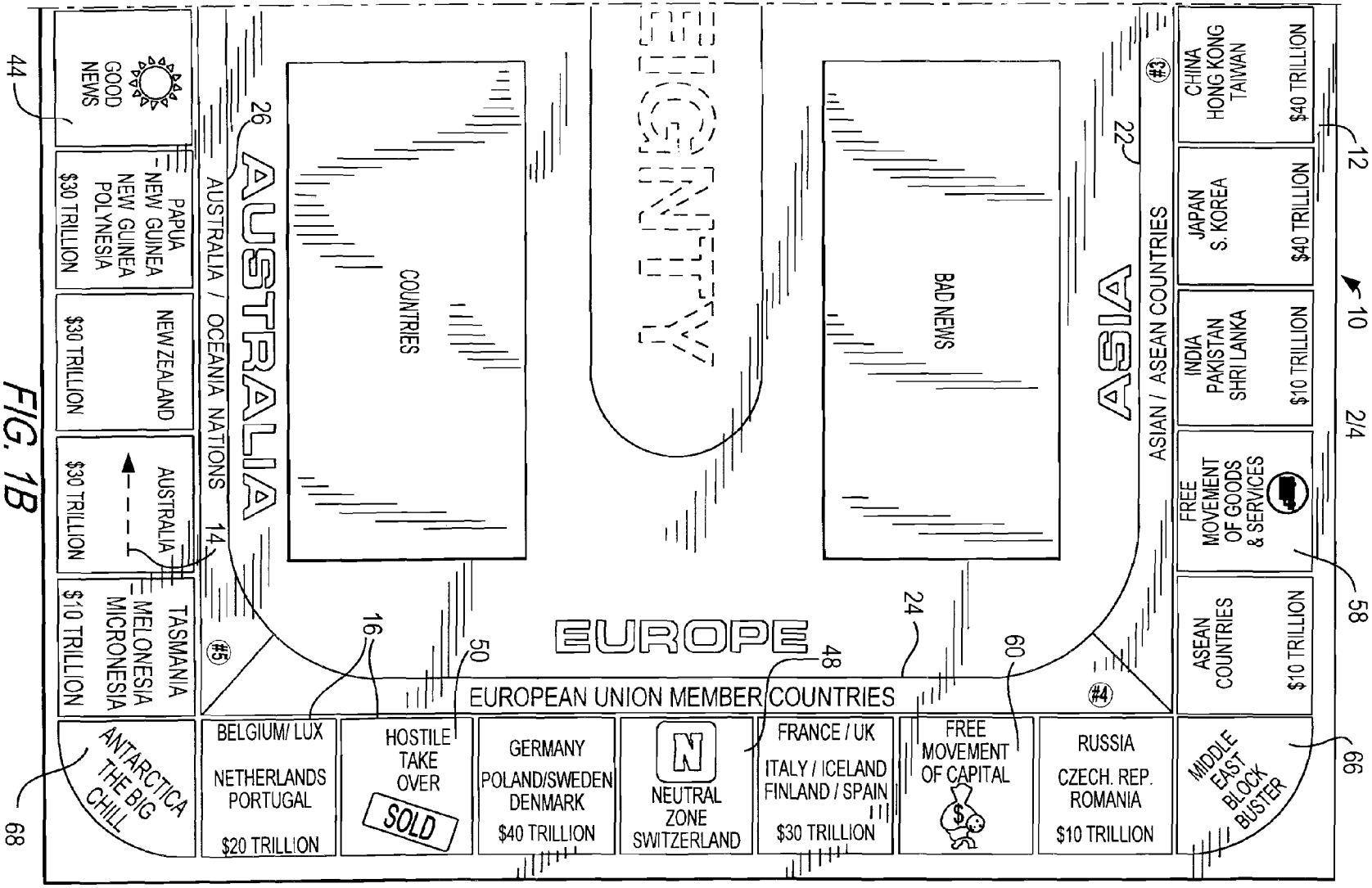
FIG. 1B is a plan view of a complimentary right-half portion of the game board.
Figure 2:
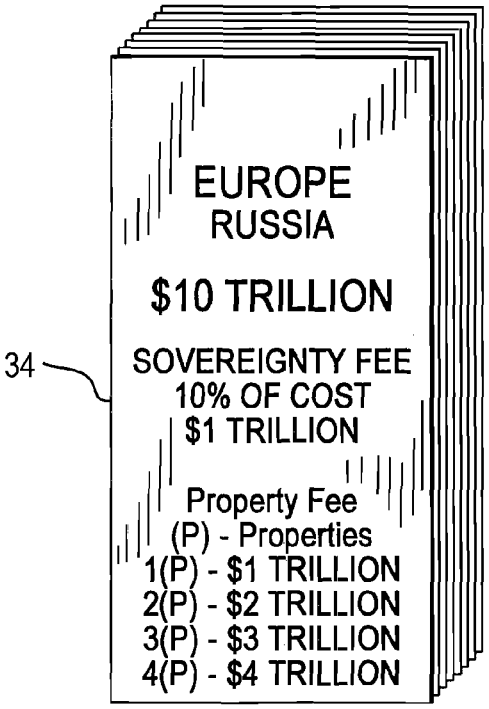
FIG. 2 is a perspective view of a stack of global country cards utilized during game play.
Figure 8:
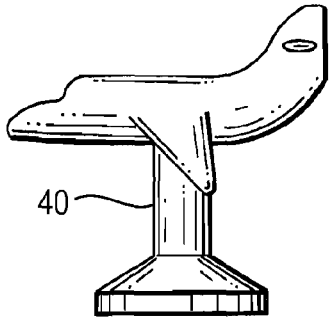
FIG. 8 is a perspective view of a representative game-piece.
Figure 7:
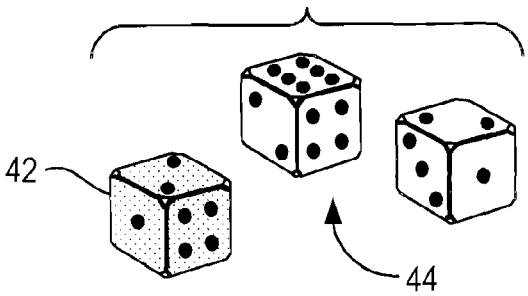
FIG. 7 is a perspective view of a set of three game dice utilized during game play.
Figure 3:
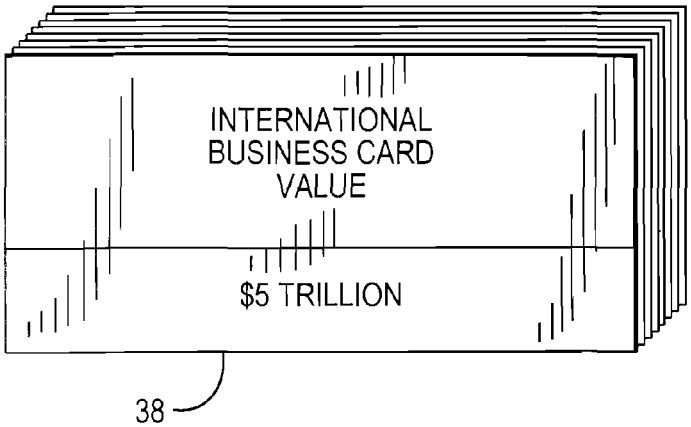
FIG. 3 is a perspective view of a stack of international business cards having various monetary denominations for use during game play.
Figure 4:
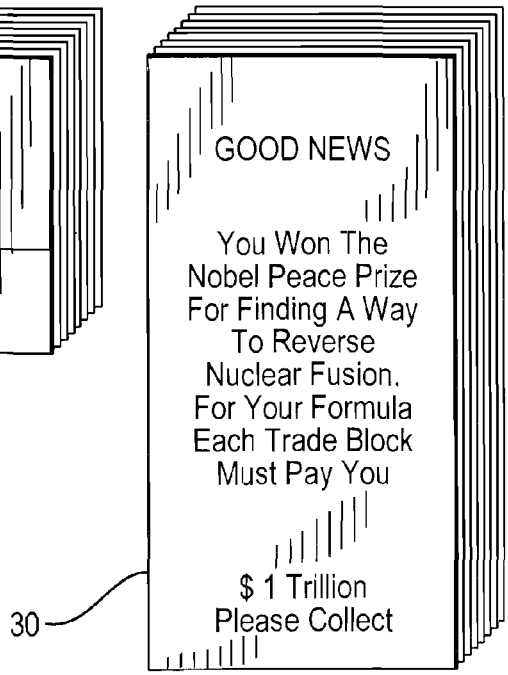
FIG. 4 is is a perspective view of a stack of "goods news" cards showing an exemplary message on one of said cards wherein the player receives an advantage.
Figure 5:
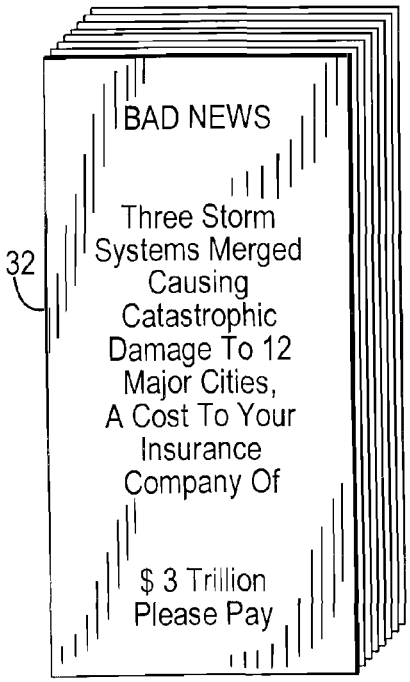
FIG. 5 is a perspective view of a stack of "bad news" cards showing an exemplary message on one of said cards wherein the player receives a penalty.
Figure 6:
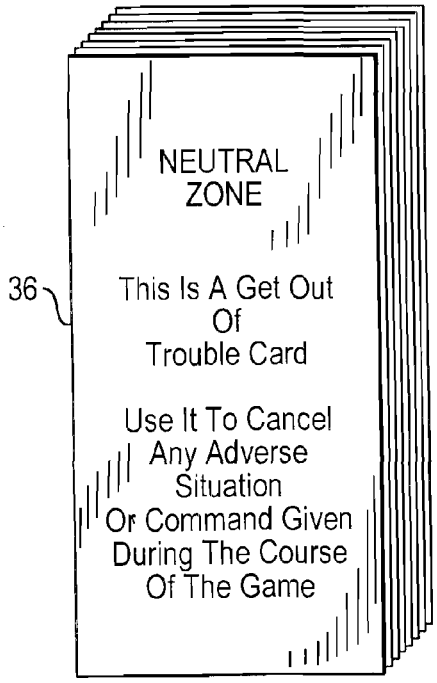
FIG. 6 is a perspective view of a stack of "neutral zone" cards showing an exemplary message on one of said cards wherein the player can cancel a penalty.

Referring now in detail to the drawings, the reference numeral 10 denotes generally a global property trading board game in accordance with this invention. The board game 10 includes a game board 12, as illustrated in FIGS. 1A and 1B, having a substantially smooth planar surface bearing a pattern on one face thereof which defines a travel path 14. The travel path 14 is segregated into spaces or stations 16 including stations associated with designated countries and having a designated asset evaluation based on its representative gross domestic product.

The game board 12 is further divided into six global regions, namely, North American Free Trade Area 18, African Union Countries 20, Asian/Asean Countries 22, European Union Member Countries 24; Austria/Oceania Nations 26, and South American Community of Nations 28. The several global regions 18-28 are readily distinguishable by color. For example, the North American Free Trade Area 18 is in the color "blue"; the African Union Countries 20 in the color "green"; the Asian/Asean Countries 22 is in the color "tan". Furthermore, within each of the global regions 18-28, there are four stations 16 that are identified by a country designation being representative of countries indigenous to the respective global region. Also, a numeral designation in each of the global regions 18-28 indicates the game starting station 16.

The game board 12 further includes designated areas for placement a plurality of game cards, namely, "goods news" cards 30, "bad news" cards 32, "country" cards 34, and "neutral zone" cards 36. Further with regard to the cards 30, 32 and 36, each of these cards bears a message—the "good news" cards 32 provide the player with an advantage, the "bad news" cards 32 provide the player with a penalty, and the "neutral zone" cards 36 provide the player with an opportunity to nullify a penalty. More specifically and by way of example, the "good news" cards 30 include the following messages:

- You won the Nobel prize for finding a way to reverse nuclear fusion. For your formula each trade-bloc must pay you $1 Trillion, please collect;
- Your country signed a 10 year contract to supply the world's 10 largest countries with grain, yielding you a profit of $1 Trillion, please collect;
- Due to a boom in manufacturing, your country's economy grew by 20% this percentage accounts for, $2 Trillion please collect;
- For the last 10 years your global insurance company has been increasing at a yearly rate of 50%, and now has a net worth of $2 Trillion, please collect;
- Your global aviation company just sold on the European stock market for $2 Trillion, please collect;
- You found a cure for the bird flu and averted the tragedy of many lives, to date your vaccine has earned you $3 Trillion, please collect;
- Your company has been contracted to build space shuttles and rockets for 6 large nations totaling $4 Trillion, please collect;
- Congratulations you have invented a new fuel source that replaces oil, and have just sold your first global order for $5 Trillion, please collect;
- You were voted global hero for finding a cure for the aids virus and have been awarded $6 Trillion, please collect;
- Your hover car replaced the motor car; earnings on your first shipment $7 Trillion, please collect;
- 5 years ago on your first trip to the moon you discovered a precious metal called, "Urichium" today it is worth $8 Trillion, please collect; and
- Your international pharmaceutical company discovered a cure for cancer, your first year's profit $8 Trillion, please collect.

With regard to the bad news cards 32 the following are typical messages:

- A computer virus called, "shut down" corrupted computers all over your country; cost to replace those computers $1 Trillion, please pay;
- Your country's currency devalued by 25% causing a substantial lost of revenue of $2 Trillion, please pay;
- Dangerous ultraviolet rays penetrated the ozone layer causing a nation wide black-out; cost to repair your electrical power grids $2 Trillion, please pay;
- A new strain of flu virus broke out in your country causing a mass pandemic; cost of curable vaccines $2 Trillion, please pay;
- Three storm systems merged causing catastrophic damage to 12 major cities; a cost to your insurance company of $3 Trillion, please pay;
- A 200 foot super Tsunami caused severe damage to your country's hotel industry and coastlines; cost of reconstruction $3 Trillion, please pay;
- Your country's oil reserves ran out forcing you to develop a new form of fuel; cost to implement $3 Trillion, please pay;
- Due to severe famine your country is forced to buy food from a foreign nation; cost to you $4 Trillion, please pay;
- A massive meteor shower rained down on your country destroying all your agricultural crops; costing you $5 Trillion, please pay;
- A massive earthquake measuring 12.5 on the Richter scale totally devastated 23 of the 56 cities in your country; cost to rebuild $7 Trillion, please pay;
- An under water volcano erupted 15 miles off the coast of your country destroying your tourism infrastructure; cost to rebuild $7 Trillion, please pay; and
- Due to severe drought your country's water supply depleted by 50% and you're forced to purchase water from another nation; cost $8 Trillion, please pay.

The above penalty payments are placed in a "players' pool", being a designated area (not shown) on or off the game board 12.

Each of the neutral zone cards bear the same exemplary message, namely.

- This is a get out of trouble card, use it to cancel any adverse situation or command given during the course of the game.

The simulated currency used in this board game 10, is in the form of a "line of credit" represented by a plurality of international business cards 38 which may be surrendered for the face amount indicated thereon in order pay the above "penalties" or to "purchase" assets as will be further discussed hereinafter. By way of example, the international business cards 38 are provided in various denominations with each denomination being color-coded, for example:

| Card value | Card color |
|---|---|
| $1 Trillion | Blue |
| $2 Trillion | Red |
| $5 Trillion | Yellow |
| $10 Trillion | Purple |
| $20 Trillion | Light gray |
| $50 Trillion | Dark gray |
| $100 Trillion | Green. |

Also included is a set of "country" cards 34 corresponding to the country designations on respective stations 16. In this typical embodiment there are a total of twenty-four country cards 34.

Each of the country cards 34 bears a respective country name corresponding to the country name on the twenty-four stations. Additionally, the country card 34 designates a purchase price for acquiring the assets and a "property fee" or tax payable by a competing player when landing within the station represented by said country card 34.

The game apparatus also includes a game-piece 40. Preferably, there are six game-pieces 40, each being color-coded to match a correspondingly color-coded global regions 18-28.

Movement of the game-piece 40 is determined primarily by the throw of three dice 44, with one game die 42, being designated the game die and being differentiated from the remaining two dice by having a different color or other markings.

General Rules of Play

The game is intended for play by from two (2) to six (6) participants. This will comfortably permit the players to position themselves around the game board 12. Each player, at the beginning of the game, is given the equivalent of $300,000 Trillion in monetary value represented by the international business cards 38. The remaining business cards 38 that have not been distributed to players are held in reserve in a "bank" placed at the side of the game board 12. Each player is also given one neutral card 36.

To start the game, each player rolls the single game die 42 to determine the starting position. For example, if the numerical die count is one, then that player's starting position is at the station marked #1, bearing the country designation "Puerto Rico, Hawaii Islands, U.S.V. Islands" located in the North American Free Trade Area 18. Similarly, starting stations in global regions 20-28 are respectively marked #2, #3, #4, #5 and #6. The player then selects a game-piece 40, in the shape of a miniature airplane, which is correspondently color-coded to the North American Free Trade Area 18. Additionally, the countries in the North American Free Trade Area 18 are assigned to and constitute that player's trade-bloc. The movement of the game-piece 40 then advances in a clockwise direction as determined by the throw of the three dice 44.

Game play progresses with each player, in order of the numerical starting position, throwing the three dice 44. The game die 42 is read first and provides for a jump move that will advance the player's game-piece 40 to one of the global regions 18-28, having the corresponding numerical starting position. This jump move helps to accelerate game play. For example, if a player in starting position #1 should throw the dice 44 and the game die 42 has a numerical equivalent of 4 on its upturned face, then the player moves his/her game-piece 40 to starting position #4 corresponding to global region 24. Then the player adds the numerical value of both of the remaining two dice and will move his/her game-piece 40 the equivalent amount of stations 16 represented by the sum of the numerical value appearing on face of each of the two dice. If the game-piece 40 is now positioned on a country station, for example, Australia, then the player may purchase the country assets for an equivalent value of $30 Trillion with payment being made to the "bank" by the international business cards 38 and the player will in return will receive a country card 34 corresponding to Australia. If however Australia is a country within a competing players' trade-bloc and said player has not purchased the assets of said country, that competing player may prevent purchase of the assets by implementing a move called "defending sovereignty". The player asserting this move must then pay the opposing player one-half the cost of the asset evaluation ($15 Trillion) for obtaining ownership of this country's assets. If however, a player lands on a country and it is not owned by another player, or a player does not wish to defend sovereignty, then that player may purchase the assets.

The owner of a previously acquired country's assets is allowed to collect "taxes" if an opposing player lands in that country. The taxes are rated at 10% of the value of the assets based on ownership of that country's assets. If a player owns the assets of two countries in his/her trade-bloc and an opposing player lands on one of said countries so owned, that player must pay to the owner taxes equivalent to 20% of the value of the assets of that country. If a player owns the assets of three countries within a trade-bloc, the taxes will be increased to 30%, and if the player owns the assets of all four countries in the trade-bloc, the taxes will be increased to 40% of the value of the assets of that country.

When a player's international business cards 38 have been substantially or completely depleted and the player can no longer defend his/her sovereignty, he may sell or redeem one or more assets back to the "bank" and receive the equivalent monetary value in international business cards 38. However, if another player's game-piece 40 should land on the so redeemed assets, he/she may buy the assets from the "bank".

It should further be noted that the travel path 14 contains "special" stations namely, a "good news" station 45, a "bad news" station 46, and "neutral zone" station 48. When a player's game-piece 40 lands on either of the stations 45, 46 he/she must select the upper most card from a corresponding stack of cards placed in the designated positions on the game board 10 and then follow the instructional message. When a player lands on the neutral zone station 48 he/she may receive a neutral card 36 from the designated position on the game board 10 which card may be held until needed to reverse an adverse situation.

A hostile takeover station 50 allows a player that lands on this station to throw the dice 44 again and that player shall be permitted to purchase any unowned asset in which his/her game-piece 40 may land without challenge from a competing player.

A station 52 designated "free zone players' pool", entitles a player whose game-piece 40 lands on this station to receive all of the international business cards 38 that have been placed in the "players' pool" as a result of penalties assessed during the previous course of play.

A station 54 designated "removal of tariffs" entitles a player to move his/her game-piece 40 around the travel path 14 without payment of any taxes to competing players for a total of three throws of the dice 44.

A station 56 designated "Bermuda Triangle", allows a player landing on this station to throw the dice 44 a second time within the same move, and if the moving player's game-piece 40 lands on a country in a trade-bloc owned by a competing player, the competing player's game-piece 40 is confiscated and the competing player misses a turn at throwing the dice 44. In order for the competing player to reenter the game he/she must pay, via international business cards 38, a fee of $5 Trillion into the "players' pool" and pay $2 Trillion to the opposing player to regain the game-piece 40. If the competing player is unable to repurchase his/her game-piece, the opposing player may confiscate one of the competing player's country's assets causing the competing player to remove himself/herself from the game with the remaining assets going to the "bank" for purchase by any other player landing on that country's station.

A station 58 marked "free movement of goods & services", will entitle the player whose game-piece 40 lands on this station to receive $1 Trillion dollars, from the player defending the trade-bloc wherein the station 58 appears, namely global region 22.

Another station 60 entitled "free movement of capital", 60, enables a player whose game-piece 40 lands within the station 60 to another throw of the dice 44 and to be exempt from taxes and from any penalties during this move.

A station 61 designated "free movement of labour & skills" entitles a player who game-piece 40 lands this station to another throw of the dice 44. If the player's game-piece 40 lands on a competing player's country station, the competing player must pay that opposing player 20% of the cost of that country's asset.

Another aspect of this board game, further intended to accelerate movement of the game-piece 40 includes the four corner spaces 62, 64, 66, 68. The station 62 is designated "CSME Caricom" and a player whose game-piece 40 lands within the station 62 is entitled to a "triple point play" wherein the player may execute three moves with one throw of the dice 44 and entitles the player to move the game-piece 40 in three consecutive moves, each move being equal to the numerical face value of one of the die, and at each move the player has an opportunity to purchase the country assets of the station landed upon.

Another corner station 64 designated "Central America Double Point" entitles the player landing thereon to a "double point play" which allows the player to throw the game dice 44 and after moving his/her game-piece 40 in accordance with game die 42, may then take two consecutive moves corresponding to the numerical face value of each of the remaining dice, thus allowing the player the possibility of purchasing the assets of two countries.

Still another corner space 66 titled "Middle East Blockbuster" provides the player who lands on this station the right to demand $1 Trillion in compensation from each of the other players or alternatively the player may demand that a competing player pay $1 Trillion for each asset the competing player owns within his/her trade-bloc.

A fourth corner station 68 is entitled "Antarctica The Big Chill". When a player lands on the station 68, that player will miss one turn of the throw of the dice 44.

The player who best defends his/her national economic sovereignty by acquiring and holding the most or all of the countries in his/her trade-bloc is the winner. The second place goes to the player who has ownership of the second most properties in his/her respective trade-bloc. In the event of a tie, the winner is that player having the largest monetary value remaining in the international business cards 38 in his/her possession.

The rules of play can be modified for a short version of the game 10 wherein the first player to acquire the assets of the four countries within his/her trade-bloc is declared the winner.

It should thus be seen that there is provided a global property board game that achieves the various preferred objects of this invention and which is well adapted to meet conditions of practical use.

Since various possible embodiments might be made in the present invention or modifications might be to the exemplary embodiments set forth, for example, the game may be digitized for electronic or computer format, it should be understood that all materials shown and described in the accompanying drawings are to be interpreted as illustrative and not in a limiting sense.

Having thus described the invention, there is claimed as new and desired to be secured by Letters Patent:

1. A method for playing a global property trading game with a plurality of players, said game including a substantially planar game board, said game board having a pattern thereon defining a continuous travel path, said travel path being divided into a plurality of stations, at least some of said stations being country-designated stations, with at least some of said country designated stations being denoted as starting stations, said starting stations having identifying indicia, said country-designated stations being grouped to define a plurality of color-coded global regions, each of said country-designated stations further being assigned a monetary asset evaluation, a plurality of business cards each having a designated monetary value, a plurality of game-pieces color-coded for correspondence with the global regions, said game-pieces being adapted for movement within said stations, a set of three dice having markings on its faces, at least two of said dice having numerical markings on each of its faces, with one of said three dice being differentiated from the other two dice, whereby a roll of the dice will randomly provide an upturned face on each of the dice, comprising the steps of:

a) distributing the business cards to each player in predetermined monetary amounts, b) rolling the single differentiated die in turn by each player, c) determining a player's initial starting station on the game board by correspondence of the identifying indicia with the markings on the upturned face of said differentiated die, d) assigning the player a color-coded global region as determined by the player's starting station, e) selecting a game-piece color-coded in correspondence with the global region for placement on the starting station, f) rolling said three dice to determine the extent of movement along the travel path of the player's game-piece, g) advancing the game-piece from the initial starting station to another starting station having identifying indicia corresponding to the markings on the upturned face of the differentiated die, h) adding the numerical markings on the upturned faces of the remaining two dice, i) moving the game-piece the equivalent amount of stations represented by the sum of the numerical markings appearing on the respective upturned faces of the two dice, and then j) optionally purchasing non-owned assets of the country-designated station in which the player's game-piece has been moved by surrendering the player's business cards in the equivalent value of the assigned monetary asset evaluation wherein the player acquiring and holding the most country-designated station assets within the respective player's global region being declared the winner.

2. A method for playing a global property trading game as claimed in claim 1 including the step of:

defending a player's sovereignty by preventing the purchase of the country-designated station assets within the player's global region by paying the opposing player one-half the value of the assigned monetary asset evaluation and acquiring ownership of the country-designated station assets.

3. A method for playing a global property trading game as claimed in claim 1 further including the step of:

selectively redeeming acquired assets to receive equivalent monetary value in business cards when redeeming player can no longer defend sovereignty.

4. A method for playing a global property trading game as claimed in claim 1 further including the step of:

paying a predetermined tax, using the player's business cards, to an opposing player when the player's game-piece lands on a country-designated station the assets of which are owned by the opposing player.

5. A method for playing a global property trading game as claimed in claim 1 further including a plurality of cards each having instructional messages that affect game play, at least one of said stations being keyed to said cards, further including the step of:

selecting a card and complying with the message thereon when a player's game-piece lands on a station keyed to said cards.

6. A method for playing a global property trading game as claimed in claim 1 wherein the travel path includes stations containing instructional messages that favorably affect movement of the game-piece, further including the step of:

allowing the player whose game-piece lands on a station containing the message, to throw the dice again and to move his game-piece in accordance with the message.

7. A method for playing a global property trading game as claimed in claim 1 wherein the travel path includes stations containing instructional messages that affect movement of the game-piece, and wherein each of the dice contains numerical markings, further including the step of:

permitting a player whose game-piece lands on a station containing the message to make three consecutive moves in accordance with the instructions, with one throw of the three dice, with each move corresponding to the numerical markings on the upturned face of one of the respective dice.

8. A method for playing a global property trading game as claimed in claim 1 wherein the travel path includes stations containing messages that penalize opposing players, further including the step of:

allowing the player whose game-piece lands on a station containing the message to receive compensation in the form of business cards having designated monetary value from each of the other opposing players.

* * * * *